US009273552B2

(12) United States Patent
Pietrala

(10) Patent No.: US 9,273,552 B2
(45) Date of Patent: Mar. 1, 2016

(54) FEED SYSTEM FOR AN UNDERGROUND WINNING MACHINE, RACK BAR AND DRIVE SPROCKET THEREFOR

(75) Inventor: Christoph Pietrala, Dortmund (DE)

(73) Assignee: Caterpillar Global Mining Europe GmbH, Lunen (DE)

( * ) Notice: Subject to any disclaimer, the term of this patent is extended or adjusted under 35 U.S.C. 154(b) by 975 days.

(21) Appl. No.: 13/500,477

(22) PCT Filed: Oct. 6, 2010

(86) PCT No.: PCT/IB2010/054518

§ 371 (c)(1),
(2), (4) Date: Apr. 5, 2012

(87) PCT Pub. No.: WO2011/042871

PCT Pub. Date: Apr. 14, 2011

(65) Prior Publication Data

US 2012/0198950 A1 Aug. 9, 2012

(30) Foreign Application Priority Data

Oct. 9, 2009 (DE) ..... 20 2009 013 326 U

(51) Int. Cl.

| | |
|---|---|
| ***E21C 29/02*** | (2006.01) |
| ***F16H 19/04*** | (2006.01) |
| ***F16H 55/26*** | (2006.01) |
| ***F16H 55/17*** | (2006.01) |

(52) U.S. Cl.

CPC ..... *E21C 29/02* (2013.01); *Y10T 74/18808* (2015.01); *Y10T 74/1967* (2015.01); *Y10T 74/19679* (2015.01)

(58) Field of Classification Search

CPC ..... E21C 29/02; B61H 13/04

See application file for complete search history.

(56) References Cited

U.S. PATENT DOCUMENTS 3,636,791 A * 1/1972 Barr ..... 74/422
4,051,745 A 10/1977 Ishikawa (Continued)

FOREIGN PATENT DOCUMENTS

CN 1062951 A 7/1992
CN 1648495 A 8/2005

(Continued)

OTHER PUBLICATIONS

Yu. A. Kukhanin et al., Safety and Fire Safety Equipment in Mechanical Engineering, Textbook for technical schools. Second Edition, Moscow, "Engineering" Publishers, 1973. (http://delta-grup.ru/bibliot/16/73.htm).

*Primary Examiner* — Terence Boes

(57) ABSTRACT

A feed system, rack bar and drive sprocket for moving an underground winning machine having a travel drive with drive sprocket having symmetrically profiled teeth, and rack bars with a plurality of rack teeth being arranged between a supporting strip and a guide strip of the rack bar. The tooth flanks of the teeth are inclined in the direction of movement and diverge towards the tooth tip for the interaction with tooth surfaces of teeth of drive sprocket. In order to improve the interaction between the teeth and produce less wear, the two tooth flanks of each rack tooth are concavely arched and form a trough between guide strip and supporting strip transversely to the direction of movement, with the trough rising towards the tooth tip, and the two tooth surfaces of each drive sprocket tooth is convexly arched and forms a crown transversely to the direction of movement.

16 Claims, 3 Drawing Sheets

(56) References Cited

U.S. PATENT DOCUMENTS

| | | | | |
|---|---|---|---|---|
| 4,155,600 | A * | 5/1979 | Lanfermann et al. | 299/43 |
| 4,782,940 | A | 11/1988 | Hogg | |
| 4,850,648 | A * | 7/1989 | Muller | 299/43 |
| 4,993,779 | A | 2/1991 | Cocksedge | |
| 8,393,687 | B2 * | 3/2013 | Powell | 299/42 |
| 2007/0125148 | A1 * | 6/2007 | Dohmann et al. | 72/352 |
| 2010/0019563 | A1 * | 1/2010 | Thomson | 299/43 |

FOREIGN PATENT DOCUMENTS

| | | | |
|---|---|---|---|
| CN | 1915773 | A | 2/2007 |
| DE | 197 46 360 | A1 | 4/1999 |
| DE | 203 15 520 | U1 | 2/2004 |
| GB | 2080370 | A | 2/1982 |

* cited by examiner

FEED SYSTEM FOR AN UNDERGROUND WINNING MACHINE, RACK BAR AND DRIVE SPROCKET THEREFOR

The invention relates to a feed system for moving an underground winning machine, in particular a shearer loader, comprising a machine-side travel drive with drive sprocket having symmetrically profiled teeth arranged in a uniformly distributed manner over the circumference, and comprising rack bars which each consist of a supporting strip, a guide strip and a plurality of rack teeth which are fixedly arranged with a predetermined pitch dimension relative to one another between the supporting strip and the guide strip and the tooth flanks of which, which are steeply inclined in the direction of movement, diverge relative to one another towards the tooth tip for the interaction of a tooth profile of the rack teeth with tooth surfaces of the teeth of the drive sprocket. The invention also relates to a rack bar for a feed system for moving an underground winning machine, in particular a shearer loader, having a travel drive with drive sprocket, which rack bar consists of a supporting strip, a guide strip and a plurality of rack teeth which are fixedly arranged with a predetermined pitch dimension relative to one another between the supporting strip and the guide strip and the tooth flanks of which diverge relative to one another towards the tooth tip for the interaction of a tooth profile of the rack teeth with teeth of the drive sprocket. Finally, the invention also relates to a drive sprocket for a travel drive of an underground winning machine, in particular a shearer loader, for moving the underground winning machine along rack bars of a feed system for the underground winning machine, having symmetrically profiled teeth which are arranged in a uniformly distributed manner over the circumference and have tooth surfaces for interaction with tooth flanks of the rack teeth.

BACKGROUND OF THE INVENTION

In the case of shearer loaders, rack arrangements are used for the feeding of the shearer loader, said rack arrangements usually being mounted on scraper chain conveyors arranged and laid at the underground longwall face, wherein the shearer loader, as winning machine, can be supported on the supporting strips by means of guide shoes and can at the same time be guided on the guide shoes. The teeth of the sprockets of the travel drive engage in the tooth gaps between the rack teeth in order to convert the rotational movement of the sprocket into a translational movement of the shearer loader. The rack arrangement is usually composed of rack bars, the length of which corresponds substantially to the length of a respective pan section of the scraper chain conveyor so that the scraper chain conveyor and in this respect also the machine track together with rack can conform to an undulating course of the winning longwall face with synclines, anticlines and curves. Due to the segmental construction of the rack arrangement on account of the individual rack bars, a shearer loader can also follow a curved course of a face conveyor and the horizontal and/or vertical bends without obstruction. In the operational use of shearer loaders, the rack bars and the entire feed system are subjected to considerable and also alternating stresses, since shearer loaders usually travel under load, but also sometimes without load, along the rack formed by the rack bars.

A feed system of the generic type having associated rack bars is known from DE 197 46 360 A1. The known feed system is successively used by the applicant under the trade name "JUMBOTRACK" or "JUMBOTRACK 2000" for a shearer loader for extracting coal in underground mining. In the rack arrangement of the generic type according to DE 197 46 360 A1, the individual rack teeth have been given special tooth profiling for improving the feed of the shearer loader and the tooth engagement relationship between the teeth of the drive sprocket and the rack teeth, said tool profiling being characterized in that the tooth flanks of adjacent rack teeth, said tooth flanks diverging relative to one another towards the tooth tip, have a relatively planar flank surface which runs inclined at an angle of about 8° to 15°, preferably 10° to 12°, to the tooth centre plane of the individual rack teeth. Owing to the fact that the tooth flanks of the rack teeth are designed as planar and steeply inclined surfaces, lifting of the winning machine on account of transverse force components and the disturbing influences resulting therefrom can be suppressed to the greatest possible extent. In order to cope at the same time with problems at the joints between adjacent rack bars, asymmetrical end teeth are used at both ends of the rack bars of the known feed system, in which end teeth the tooth flank facing the inner rack teeth is given respective tooth flank profiling which runs at a steeper angle relative to the vertical than the respectively outer tooth flank, i.e. the tooth flank facing the joint of adjacent rack bars. Due to the asymmetrical configuration of the end teeth, the tooth pitch of the rack bar in each case between two end rack teeth or end teeth of adjacent rack bars will be increased slightly compared with the standard tooth pitch.

Increasing wear in particular on the tooth shape of the drive sprocket can also occasionally occur after a long operating period in the case of the rack arrangement according to DE 197 46 360 A1. The teeth of the sprocket drive are in principle subjected to higher loads than the rack teeth since the feed forces have to be transmitted by the teeth of the drive sprockets, and the engagement of each individual tooth with a rack tooth occurs much more frequently that the loading of an individual rack tooth overall.

SUMMARY OF THE INVENTION

An object of the invention is to provide a feed system and in particular rack bars and drive sprockets therefor, in which interaction between the teeth of the drive sprocket and the rack teeth is improved even further and consequently the wear is reduced.

This object and others are achieved according to the invention in a feed system in that the two tooth flanks of each rack tooth are designed to be concavely arched transversely to the direction of movement, therefore over the width thereof, and form a trough between guide strip and supporting strip transversely to the direction of movement, and in that the two tooth surfaces of each tooth of the drive sprocket are designed to be convexly arched and form a crown transversely to the direction of movement. Due to concave arching of the tooth flanks of the rack teeth, which forms a trough, and preferably congruent convex arching of the tooth surfaces, which forms a crown, the surface pressures produced during the meshing or rolling of sprocket and rack can be reduced by up to about 12% compared with straight surfaces which were common practice in the prior art of the generic type, and at the same time centering of the drive sprocket is achieved during the feed, as a result of which the service life of the drive sprocket is significantly increased. It is in particular advantageous if the convex arching of the tooth flanks and the convex arching of the tooth surfaces have the same arching radius or arching radii which differ from one another by less than 5%.

The aforesaid object and others are accordingly achieved in a rack bar for such a feed system in that the two tooth flanks of each rack tooth are designed to be concavely arched and form a trough between guide strip and supporting strip transversely to the direction of movement, said trough rising towards the tooth tip, for interacting with a crown formed on tooth surfaces of each tooth of the drive sprocket transversely to the direction of movement.

The arching on the rack teeth and/or the arching on the teeth of the drive sprocket preferably has an arching radius which is between about ¼ and about twice the pitch dimension between the rack teeth; the arching radius can in particular be between ⅓ of the pitch dimension and the pitch dimension or about 1.2 times the pitch dimension. The arching radius can also be optimized with regard to the minimum clear distance between supporting strip and guide strip or with regard to the thickness, adapted thereto, of the teeth of the drive sprocket and can preferably be between about half the thickness and twice the thickness of the teeth or the distance.

The trough on both tooth flanks of the rack teeth preferably extends right up to the tooth tip and therefore forms a trough-like shape on the tooth flank of the rack teeth which extends over the steeply inclined flank right up to the tooth tip. At the tooth tip, however, the rack tooth preferably has, at least in the direction of movement, convex arching in order to assist the rolling operation of the tooth surfaces of the teeth of the drive sprocket. The rack teeth, in particular all the rack teeth, also preferably have a plane of symmetry intersecting the tooth tip, the tooth tip being designed to be convexly arched transversely to the direction of movement in the region of the plane of symmetry. In an especially advantageous configuration, the tooth tip is then convexly arched both in the direction of movement and transversely to the direction of movement, whereas the concave arching is in each case formed on the other regions of the tooth flanks.

The running behavior between the teeth of the drive sprocket and the rack teeth can also be improved by the rack teeth being given altered, modified profiling compared with the prior art. To this end, the drive teeth have tooth flanks, a tooth tip and a tooth base which are designed symmetrically to the tooth centre plane, wherein the tooth flanks of the rack teeth run in a curved manner between tooth base and tooth tip in each case with a predetermined radius of curvature or predetermined radii of curvature, wherein the radius of curvature close to the tooth base is preferably greater than the radius of curvature close to the tooth tip. Due to the fact that the radii of curvature preferably decrease gradually, unlike in the case of the prior art, recourse is had to tooth profiling having curved tooth flanks in the direction of movement in order to further improve the running behavior of the teeth of the sprocket on the rack teeth. Due to the altered tooth profiling, an increase in the cross-sectional area of more than 10% and in this respect a further improvement in the planar moments of inertia can be achieved compared with the tooth profile in the rack arrangement of the generic type. On account of the radii of curvature on the tooth flank, harmonic and more uniform running on the rack teeth is achieved. At the same time, the slip rubbing speed can be reduced.

According to a further advantageous configuration of the feed system, the running over the joints or gaps between adjacent rack bars can be improved by virtue of the fact that the rack bars have, at both ends, end teeth formed symmetrically to an end tooth centre plane, the end tooth tip of which lies lower than the tooth tip of the other rack teeth of the same rack bar. The minimized height of the end teeth relative to the adjacent, inner rack teeth, or the lower tooth tip of the end teeth, and the symmetry of the end teeth ensure, for both directions of movement of the shearer loader, that the drive sprocket, when rolling over the joint or the pitch increase between adjacent rack bars, can come down on the end tooth in an improved manner and if need be can be set in a forward movement, as a result of which the drive sprocket, in a favorable manner, moves onto the next rack bar earlier than in the prior art. At the same time, it is ensured that the tooth of the drive sprocket which lies in the joint gap between the adjacent rack bars can sit freely between both rack bars and in this respect is not exposed to any increased wear in particular at this critical location. Due to the fact that the end tooth is minimized in height and is at the same time symmetrical, it is also ensured for both directions of movement that no jamming of the drive sprocket can occur. In this case, the tooth of the drive sprocket which sits in the joint gap can remain in contact with the end teeth for a longer time overall than was the case in the prior art. Even when passing through a syncline, when the pitch gap between adjacent rack bars is minimal, improved running behavior is achieved since here, too, sufficient free space remains for the tooth of the sprocket that is instantaneously sitting in the pitch gap to roll past and continue rotating at both end teeth. The end teeth also expediently have an end tooth profile having end tooth flanks, an end tooth tip and an end tooth base which are designed symmetrically to the end tooth centre plane, wherein the end tooth flanks of the end teeth run in a curved manner between end tooth base and end tooth tip in each case with a predetermined radius of curvature or predetermined radii of curvature, wherein the radius of curvature close to the end tooth base is preferably greater than the radius of curvature close to the end tooth tip.

It is especially advantageous if the radius of curvature close to the tooth base is greater than close to the tooth tip. The radii of curvature on the end tooth on the one hand and on the rack tooth on the other hand are also preferably in each case the same size, even though the radius of curvature varies in each case, in a distributed manner over the tooth flank, in particular decreases gradually towards the tooth tip. It is even more advantageous if the tooth flanks between tooth base and tooth tip have at least three radii zones having different radii of curvature, between which a radii change is formed in each case. In the relationship between end tooth and "normal" rack tooth, it is especially advantageous if the radii changes at the end tooth in each case lie lower than the radii changes at the adjacent rack tooth lying on the inside relative to the end tooth or at all the inner rack teeth. According to an advantageous configuration, the tooth flank in the region of the tooth base can run in a curved manner in each case with the largest radius of curvature, wherein the largest radius of curvature is preferably approximately 1.6 times to 2.1 times greater than the tooth height of the inner rack teeth and/or is approximately 1.8 times to 2.15 times greater than the tooth base width of the rack teeth or end teeth.

Furthermore, the rack teeth can preferably be provided with boundary layer hardening in the region of the troughs and/or the teeth of the drive sprocket are provided with boundary layer hardening in the region of the crowns.

The rack teeth can be provided with concave arching radii which extend continuously and with a constant value over the width of the teeth. According to an especially advantageous configuration, the rack teeth have a flat portion in the region of a trough centre line, wherein the trough in the region of the flat portion is preferably planar. The rack teeth are therefore given troughs having a trough bottom which is partly planar on account of the flat portion and is orthogonal to the direction of movement, wherein the arching is formed only on both sides or flanks of the flat portion. In this case, the flat portion can preferably have a width which is about 1/10 to 1/7 of the distance or clear, minimum opening width between supporting strip and guide strip. The flat portion on the rack teeth and the flat portion on the teeth of the rack sprocket preferably have the same width. The degree of arching on both flanks of the flat portion is preferably the same size, but can also be different.

The above objects are also achieved by a drive sprocket in which the tooth surfaces of each tooth of the drive sprocket are designed to be convexly arched and have transversely to the direction of movement a crown for interacting with a trough formed on the tooth flanks of each rack tooth. It is also especially advantageous in the case of the teeth of the drive sprocket if the teeth have tooth surfaces, a tooth end face and a tooth root which are designed symmetrically to a plane, wherein the tooth surfaces of the teeth run in a curved manner between tooth root and tooth end face in each case with a predetermined radius of curvature or predetermined radii of curvature. In an especially advantageous configuration, the teeth have a flat portion in the region of a crown centre line, wherein the crown in the region of the flat portion is preferably planar and/or the flat portion has a width which is about 1/10 to 1/7 of the thickness of the teeth. The arching forming the crown is therefore located only to the side of the preferably planar flat portion.

These and other objects, aspects, features, developments and advantages of the invention of this application will become apparent to those skilled in the art upon a reading of the Detailed Description of Embodiments set forth below taken together with the drawings which will be described in the next section.

DETAILED DESCRIPTION OF EMBODIMENTS

Figure 1:
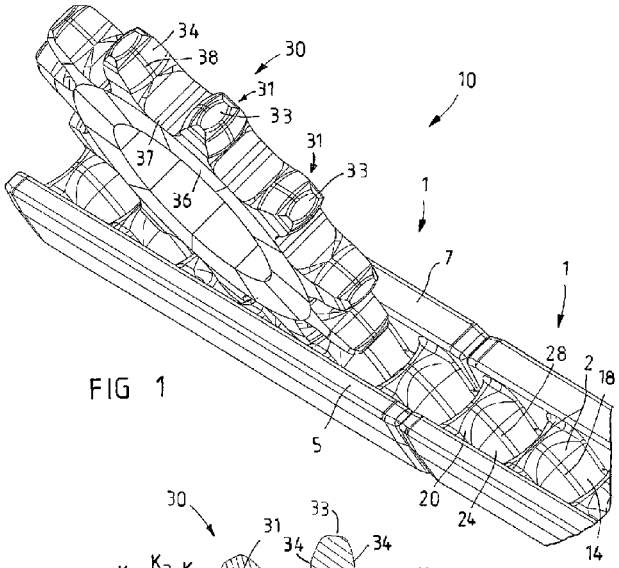
FIG. 1 shows a perspective view of a drive sprocket and rack bars of a feed system according to the invention of a winning machine.
Figure 2:
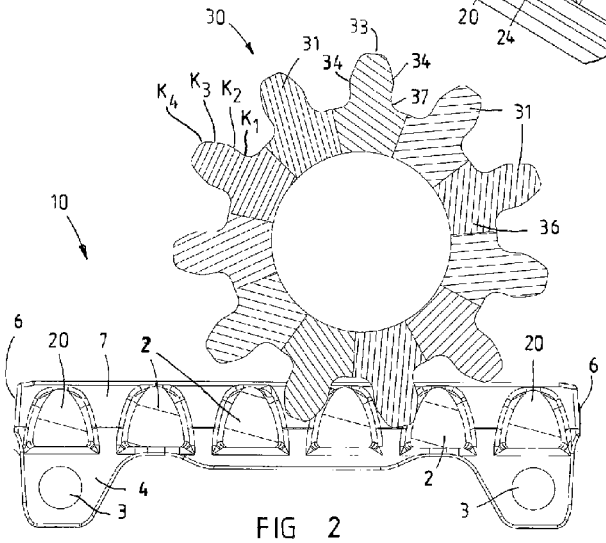
FIG. 2 shows the feed system from FIG. 1 in side view in vertical section through rack bar and drive sprocket.
Figure 3:
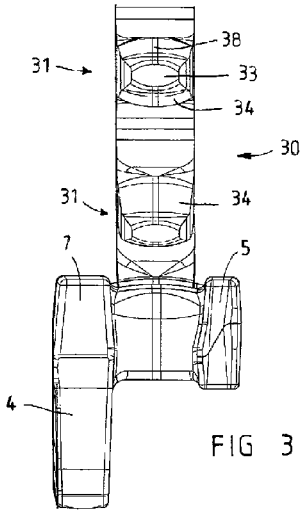
FIG. 3 shows the feed system from FIG. 1 in an end view of a rack bar, with only half of the drive sprocket being shown.

Referring now to the drawings wherein the showings are for the purpose of illustrating preferred and alternative embodiments of the invention only and not for the purpose of limiting same, shown is a feed system according to the invention for a winning machine (not shown in any more detail), such as, in particular, a shearer loader with travel drive, is designated overall by reference numeral 10 in FIGS. 1 to 3. A rack arrangement is provided for moving the winning machine, said rack arrangement normally being formed from a multiplicity of successive rack bars, only two rack bars 1 being shown in FIG. 1. Since a longwall face as a rule can have a face length of between usually 100 m up to, in the meantime, over 400 m, a multiplicity of rack bars 1 of identical construction following one another in a row are required in order to be able to move the winning machine back and forth between both ends of the longwall face. Each rack bar 1 consists of a relatively sturdy supporting strip 7, on each end 6 of which are formed, as shown in particular by FIGS. 2 and 3, a downwardly projecting coupling extension 4 having a pin hole 3 for the passage of a fastening pin (not shown) with which the rack bars 1 can be fastened to bearing brackets (not shown), which in turn are fixed to pan sections of a face conveyor, as a rule on the goaf side, as is generally known to the person skilled in the art in underground mining, so that the winning machine can move parallel to the longwall face and can extract minerals, such as, in particular, coal, at a working face and at the same time the material extracted by the shearer loader can be transported away by the face conveyor. Furthermore, each rack bar 1 consists of a guide strip 5 without coupling extensions, which runs at a distance from and parallel to the supporting strip 7, and of a plurality of rack teeth 2 and 20, which in this case are each forged onto or welded to those strip surfaces of the supporting strip 7 and the guide strip 5 which face one another.

Furthermore, the feed system for a winning machine comprises a drive sprocket 30 which has, on the circumference thereof, in this case eleven teeth 31 which are designed identically to one another and are distributed uniformly over the circumference and the tooth surfaces 34 of which are designed to be convexly arched in the direction of movement like a cycloidal tooth system. All the teeth 31 of the drive sprocket 30 have the same construction and have tooth surfaces 34 designed symmetrically to a tooth centre plane, a tangential end face 33, which is flat in this case, and a respective tooth root 37 on the sprocket body 36. The tooth surfaces 34 of the teeth 31 run between tooth root 37 and tooth end face 33 in a curved manner in the direction of movement in each case with a predetermined radius of curvature or predetermined radii of curvature $K_1$, $K_2$, $K_3$, $K_4$. Directly adjoining the tooth root 37, each tooth 31 has a fillet having the radius of curvature $K_1$, adjoining which are the steeply inclined areas of the tooth surface 34, first of all with a transition radius $K_2$. Almost the entire frontal area of the tooth surface 34 has in this case a constant radius of curvature $K_3$ in the direction of movement, which merges into the end face 33 via a relatively small radius of curvature $K_4$. The teeth 31 of the drive sprocket 30 mesh with the rack teeth 2 of the rack bar 1. The drive sprocket 30 is normally connected to a rotary drive (not shown) which is fastened to an underground winning machine (likewise not shown), such as, in particular, a shearer loader, wherein a corresponding shearer loader has, as a rule, two drive sprockets 30 arranged at a distance from one another and having associated rotary drives in order to obtain the feed and travel drive of the shearer loader relative to the rack arrangement formed with the rack bars 1.

Figure 6:
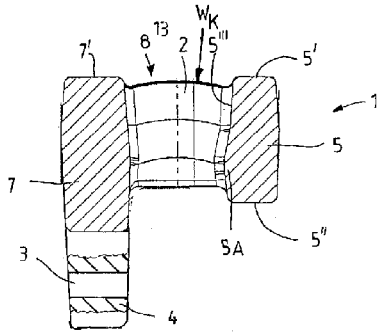
FIG. 6 shows a vertical section through a rack bar according to the invention, partly truncated.
Figure 7:
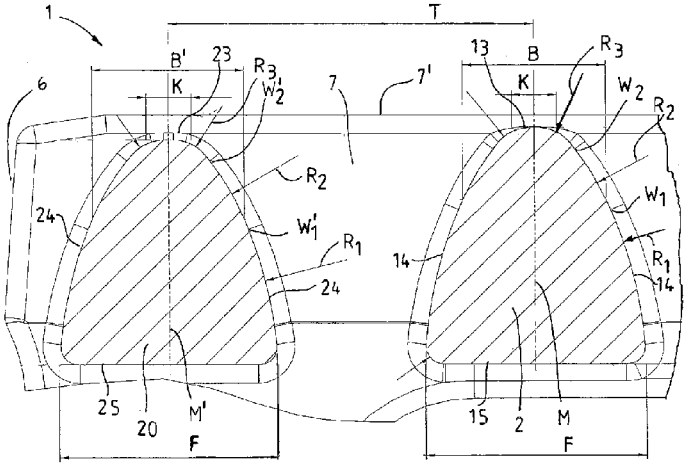
FIG. 7 shows the end of the rack bar according to the invention from FIG. 5 in longitudinal section along VII-VII in FIG. 5.

Reference will now be made first of all to FIGS. 6 and 7, in which a rack bar 1 is shown. The top side 7' of the supporting strip 7 and the top side 5' of the guide strip 5 form a bearing surface for a guide shoe, with which the underground winning machine is guided on the rack bar 1. Since the underside 5" of the guide strip 5 has no coupling extensions, such a guide shoe can engage beneath the guide strip 5 and also behind the supporting strip 7 in order to achieve specific guidance and in particular secured tooth engagement between the teeth of the drive sprocket (30, FIG. 1) and the rack teeth 2 of the rack bars 1. Close to the underside 5", the guide strip 5 is wider than in the region of the top side 5', since it is provided with a bulge 5A on the inner surface 5'" facing the supporting strip 7, the engagement gap 8 between those surfaces of the supporting strip 7 and the guide strip 5 which face one another being narrowed slightly towards the bottom to a minimum distance A by said bulge 5A.

In the exemplary embodiment shown, the rack bars 1 and, in this respect, also the entire feed system have, at both ends, an end tooth 20 as a rack tooth of special design, each of these end teeth 20, as clearly shown in particular by FIG. 7, having a smaller height than an adjacent inner rack tooth 2 of "normal" design. This smaller height also indicates that the end tooth has an end tooth tip 23 which is at a greater distance from the top side 7' of the supporting strip 7 than the tip 13 of the adjacent rack tooth 2 or of all the other inner rack teeth 2. A significant feature for the present invention consists in the profiling of the tooth flanks 24 of the end teeth 20 and of the tooth flanks 14 of the rack teeth 2 and this will now be explained with additional reference to FIGS. 1 to 5. In FIG. 7, only one end of a rack bar 1 is shown and the section through the rack bar 1 lies centrally between the supporting strip 7 and the guide strip, which is not shown in this view. The rack tooth 2 has two tooth flanks 14 which point in the direction of movement of the underground winning machine and are designed symmetrically to a vertical tooth centre plane M, and the end tooth 20 also has an end tooth flank 24 on both sides, both end tooth flanks 24 being designed symmetrically to the vertical end tooth centre plane M'. Both the tooth flank 14 of each rack tooth 2 and the end tooth flank 24 of the end tooth 20 run over the entire height from the tooth base 15 and the end tooth base 25, respectively, up to the tooth tip 13 and the end tooth tip 23, respectively, in a convexly curved manner in the direction of movement, the end tooth flank 24 and the tooth flanks 14 or the tooth flanks 14 of adjacent rack teeth diverging relative to one another towards the tooth tip 13 and the end tooth tip 23, respectively. Both the rack tooth 2 and the end tooth 20 have a first, bottom radii zone, which in each case runs in a curved manner with the radius of curvature $R_1$, adjoining which first radii zone is a second radii zone which runs in a curved manner with the radius of curvature $R_2$ in both the end tooth 20 and the rack tooth 2, and have a third radii zone having the radius of curvature $R_3$, said third radii zone merging into the tooth tip 13 or the end tooth tip 23. Despite the smaller overall height of the end tooth 20, the radii of curvature $R_1$, $R_2$, $R_3$ on the rack tooth 2 and on the end tooth 20 are the same size; the radii change $W_1$ or $W_1'$ between the largest radius of curvature $R_1$ which adjoins the toothbase 15 or the end toothbase 25, respectively, is effected at different heights with respect to the tooth tip 13 or the end tooth tip 23, respectively, or the tooth base 15 or the end tooth base 25, respectively. As can readily be seen from FIG. 7, the radii change $W_1$ on the rack tooth 20 between the radii $R_1$ and $R_2$ lies substantially higher than the radii change $W_1'$ on the end tooth 20. Equally, the radii change $W_2'$ on the end tooth 20 also lies substantially lower or, with respect to the top side 7' of the supporting strip, at a greater distance from said top side 7' than the radii change $W_2$ between the radii $R_2$, $R_3$ on the rack tooth 2. Nonetheless, the rack teeth 2 and the end teeth 20 have the same base width F or tooth base width F and also the same tip width K on the actual tooth tip 13 and end tooth tip 23, respectively. The radius $R_1$ can preferably be approximately twice as large as the base width F, the radius $R_2$ can preferably be 1.1 times to 1.2 times larger than the base width F, and the radius $R_3$ is preferably 0.15 to 0.25 times smaller than the base width F. On account of the different levels of the radii changes $W_1$, $W_1'$, the end tooth 20 at the height of the bottom radii change $W_1'$ has a larger tooth width B' than the rack tooth 2 in the region of the radii change $W_1$, as can readily be seen when comparing the tooth widths B, B'. The distance between the tooth centre planes M or the distance between the tooth centre plane M and the end tooth centre plane M' corresponds to the pitch T in the rack bar 1, a rack bar with an average pitch dimension being shown in FIG. 7, which in this case is about 1.6 times the tooth base width F. The pitch dimension T between the rack teeth 2 (or between rack tooth 2 and end tooth 20) can vary depending on the application, there normally being an identical pitch dimension T between all the rack teeth 2 and also to the end tooth 20 in all rack bars 1 of a feed system. Compared with the prior art, the contact surfaces of the rack teeth 2 and of the teeth 31 of the drive sprocket 30 are already widened by the rounding of the tooth flanks 14 and 24 in the direction of movement with the rounding radii $R_1$, $R_2$, $R_3$ and by the rounding $K_2$ and in particular the rounding $K_3$ on the teeth 31, as a result of which the wear during the interaction of the teeth 31 of the drive sprocket 30 and the rack teeth 2 of the rackbar 1 is reduced. The radius of curvature $K_3$ is preferably smaller than the rounding radius $R_1$ and larger than the rounding radius $R_2$ and can be approximately around $0.65 \times R_1 \leq K_3 \leq 0.85 \times R_1$.

Figure 4:
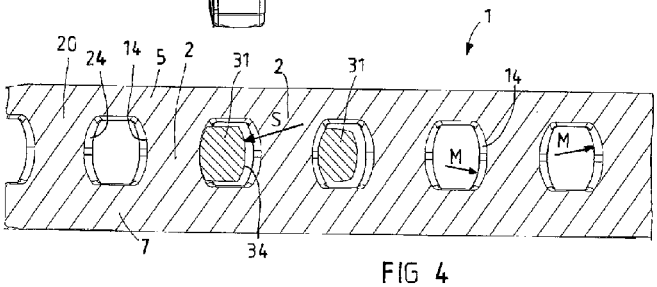
FIG. 4 shows a horizontal section through a rack bar during the engagement of two teeth of the drive sprocket in the gaps between the rack teeth.
Figure 5:
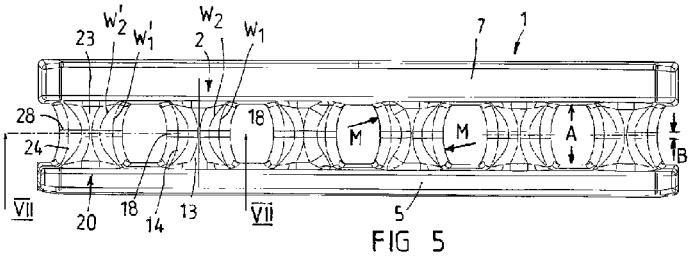
FIG. 5 shows a rack bar according to the invention in plan view.

A feature important to the invention in the feed system 10 shown in the figures consists in concave arching, resulting in a trough, of the tooth flanks 14 and 24 transversely to the direction of movement and in convex arching, resulting in a crown, of the tooth surfaces 34, and reference will now be made in particular to FIGS. 4 and 5, from which this feature can be seen especially well. The crown-shaped arching with the arching radius S on the tooth surfaces 34 of the drive teeth 31 and the arching, resulting in a trough, with the arching radius M on the tooth flanks 14 of the rack teeth 2 become especially clear from the horizontal section through a rack bar 1 with the inner rack teeth 2 and the drive teeth 31 meshing with the latter. It can readily be seen from the plan view in FIG. 5 that the arching extends over the entire height of the rack teeth 2 and the end teeth 20 and provides the tooth flanks 14 and 24 with a trough-shaped recess transversely to the direction of movement. In the exemplary embodiment shown, the arching does not run in the region of the tooth tip 13 of the inner rack teeth 2 or in the region of the end tooth tip 23 of the end tooth 20. However, the concave arching on the tooth flanks 14, 24 of all the drive teeth 2, 20 extends with an arching radius M, which is preferably uniform over the height, both above and below the respectively lower radii change $W_1$ or $W_1'$ and the higher radii change $W_2$ or $W'_2$ and therefore over all the regions having the rounding radii $R_1$, $R_2$ and $R_3$ on the end tooth 20 and on the rack tooth 2. The rack teeth 2 and the end teeth 20 therefore have convex arching with the rounding radii $R_1$, $R_2$, $R_3$ in the direction of movement and concave arching with the arching radius M transversely to the direction of movement.

In the exemplary embodiment shown, the arching radius M does not run continuously over the width or thickness of the rack teeth 2 or end teeth 20, but rather a flat portion is formed in the region of the hollow base 18 or 28, as symbolized by the double line, said flat portion limiting the arching transversely to the direction of movement only to the two side regions of the tooth flanks 14, 24. In this case, in the exemplary embodiment shown, the arching radius M is the same size on both sides of the flat portion 18 or 28; however, it could also have different sizes or else become larger towards the outside within the arching radius.

The teeth 31 of the drive sprocket 30 preferably have convex curvature with the radii of curvature $K_1$, $K_2$, $K_3$, $K_4$ in the direction of movement and convex arching with the arching radius S transversely to the direction of movement. Like the rack teeth 2 and 20, all the teeth 31 of the drive sprocket 30 have a flat portion 38 in the region of the crown centre line in the exemplary embodiment shown, said flat portion 38 in turn extending over the entire tooth flank 34 but not right into the tooth end face 33, which is of substantially flat design anyway. Corresponding to the arching radii on the rack teeth, the arching radius S on the tooth surfaces 34 can also be the same size on both sides of the flat portion 38 or can have different sizes, the same radii M, S preferably being used on rack tooth 2 and tooth 31 of the sprocket 30. In the exemplary embodiment, the width of the flat portion 18 on the rack tooth 2 or of the flat portion 28 on the end tooth 20 is around 70% of the minimum clear distance A between guide strip 5 and supporting strip 7, i.e. the ratio of the width B of the flat portion 18, 28 to the gap width A at the rack bars 1 can be approximately specified as $\frac{1}{10}\times A \leq B \leq \frac{1}{7}\times A$. The arching radii M and S of the tooth surfaces 34 of the teeth 31 and respectively of the tooth flanks 14, 24 of the rack teeth 2, 20 can be influenced, inter alia, by the pitch dimension T, which in turn depends on the number of teeth on the drive sprocket, but also on the width or thickness of the teeth on the drive sprocket 30. The arching radii M and S can be approximately specified as $\frac{1}{3}T \leq M = S \leq 1.2\times T$. Drive sprockets for feed systems for underground mining machines have, as a rule, 9 to 14 teeth and usually have a diameter of between about 300 mm and 800 mm; the arching radii M, S can accordingly be between about 50 mm and 200 mm in order to achieve the best possible minimum surface pressure between the rack teeth and the teeth of the drive sprocket.

Despite the trough-shaped arching of the tooth flanks 14 of the rack teeth 2 or of the tooth flanks 24 of the end teeth 20, all the rack teeth 2, 20 are designed symmetrically to a tooth centre plane M or M', respectively, this plane of symmetry intersecting the tooth tip 13 of the rack teeth 2 and respectively the tooth tip 23 of the end teeth 20, as can be seen especially well from FIG. 7. In the plane of symmetry M, however, the tooth tip 13 is in turn convexly arched transversely to the direction of movement, as can be seen especially well from FIG. 6. The tooth tip 13 therefore sinks, as also illustrated in FIG. 5, down towards the guide strip 5 and the supporting strip 7 transversely to the direction of movement and at the same time widens on account of the concave arching, adjoining the tooth tip, of the tooth flanks 14 and 24, as can be seen especially well from the plan view of the rack bar 1 in FIG. 5. The arching dimension $W_K$ at the tooth tip 13, and accordingly also at the tooth tip 23 of the end teeth 20, is preferably larger than the pitch T and is approximately within the range of $1.5\times T \leq W_K \leq 2\times T$.

For the person skilled in the art, numerous modifications which are to come within the scope of protection of the attached claims emerge from the above description. It is not shown in the figures that the rack bars can be mounted in particular on one side in brackets having elongated holes in order to not only improve the running of the rack arrangements in synclines and anticlines but also to make possible, if need be, certain play of the rack bars. In another tooth shape of the teeth of the drive sprocket, the profiling of the rack teeth and the profiling of the end teeth can be slightly different. The rack teeth can also be provided with boundary layer hardening in the region of the troughs and/or the teeth of the drive sprocket can be provided with boundary layer hardening in the region of the crowns. The exemplary embodiment shown shows the preferred configuration of a rack bar having end teeth which are smaller than the inner rack teeth. Those rack bars in which all the rack teeth have the same profile or in which possibly end teeth have an asymmetrical profile are also to come within the scope of protection. The rack teeth and the teeth of the drive sprocket can also be designed without a flat portion. The provision of identical arching radii over the entire tooth flank of the rack teeth or over the entire tooth surface of the teeth of the drive sprocket is also especially advantageous from the production point of view. However, the flat portion can also be omitted and/or the radius of curvature can vary between both sides of the crown line or trough line.

Further, while considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. Accordingly, it is to be distinctly understood that the foregoing descriptive matter is to be interpreted merely as illustrative of the invention and not as a limitation.

The invention claimed is:

1. A rack bar for a feed system for moving an underground winning machine having a travel drive with a drive sprocket, the rack bar comprising:

a supporting strip;

a guide strip; and a plurality of rack teeth arranged with a predetermined pitch dimension relative to one another between the supporting strip and the guide strip, each of the plurality of rack teeth having tooth flanks that diverge relative to one another towards a tooth tip for the interaction of a tooth profile of the plurality of rack teeth with associated teeth of the drive sprocket, the tooth flanks of each of the plurality of rack teeth being concavely arched and forming a trough between the guide strip and the supporting strip transversely to a direction of movement, wherein the trough rises toward the tooth tip for interacting with a crown formed on drive sprocket tooth surfaces of each associated drive sprocket tooth of a plurality of drive sprocket teeth of the drive sprocket transversely to the direction of movement, wherein the plurality of rack teeth include inner rack teeth and, at both ends, end teeth formed symmetrically to an end tooth centre plane and having an end tooth tip, the end tooth tip being lower than the tooth tip of the inner rack teeth.

2. The rack bar according to claim 1, wherein at least one of an arching on the plurality of rack teeth and an arching on the plurality of drive sprocket teeth has an arching radius between about ¼ and twice the predetermined pitch dimension.

3. The rack bar according to claim 1, wherein at least one of an arching on the plurality of rack teeth and an arching on the plurality of drive sprocket teeth has an arching radius which is between ⅓ times the pitch dimension and 1.2 times the pitch dimension.

4. The rack bar according to claim 1, wherein the trough extends up to the tooth tip.

5. The rack bar according to claim 1, wherein the plurality of rack teeth have a plane of symmetry intersecting the tooth tip, the tooth tip being convexly arched transversely to the direction of movement in the plane of symmetry.

6. The rack bar according to claim 1, wherein the plurality of rack teeth further includes a tooth base opposite of the tooth tip, wherein the tooth flanks, the tooth tip, and the tooth base are symmetrical about a tooth centre plane.

7. The rack bar according to claim 6, wherein the tooth flanks of the plurality of rack teeth run in a curved manner between the tooth base and the tooth tip with a first radius of curvature proximate to the tooth base and a second radius of curvature proximate to the tooth tip, the first radius of curvature being greater than the second radius of curvature.

8. The rack bar according to claim 1, wherein the end teeth have an end tooth profile having end tooth flanks, and an end tooth base positioned symmetrical about the end tooth centre plane.

9. The rack bar according to claim 8, wherein the end tooth flanks of run in a curved manner between the end tooth base and the end tooth tip with a first radius of curvature proximate to the end tooth base and a second radius of curvature proximate to the end tooth tip, the first radius of curvature being greater than the second radius of curvature.

10. The rack bar according to claim 1, wherein the inner rack teeth have inner tooth flanks, an inner tooth tip, and an inner tooth base positioned symmetrical about an inner tooth centre plane, wherein the inner tooth flanks run in a curved manner between the inner tooth base and the inner tooth tip and have at least one inner tooth radius of curvature, and the end teeth have an end tooth profile having end tooth flanks, and an end tooth base positioned symmetrical about the end tooth centre plane, wherein the end tooth flanks of the end teeth run in a curved manner between the end tooth base and the end tooth tip and have at least one end tooth radius of curvature, the at least one end tooth radius of curvature and the at least one inner tooth radius of curvature being the same size.

11. The rack bar according to claim 1, wherein the inner rack teeth have inner tooth flanks between an inner tooth base and the tooth tip of the inner rack teeth, and wherein between an end tooth base of the end teeth of the inner teeth and the end tooth tip, as well as between the inner tooth base and the tooth tip of the inner rack teeth, there are at least three radii zones having different radii of curvature, and between each of the at least three radii zones, a radii change is formed, wherein the radii changes at the end teeth lie lower than the radii changes at the inner rack teeth.

12. The rack bar according to claim 1, wherein tooth flanks of the end teeth and tooth flanks of the inner rack teeth at the tooth bases of the end teeth and tooth bases of the inner rack teeth, respectively, run in a curved manner with one or more radii of curvature, wherein at least one of the radii of curvature is approximately 1.6 times to 2.1 times greater than a tooth height of the inner rack teeth and is approximately 1.8 times to 2.1 times greater than a tooth base width of the inner rack teeth.

13. The rack bar according to claim 1, wherein at least one of the plurality of rack teeth is provided with boundary layer hardening in the region of the trough.

14. The rack bar according to claim 1, wherein the plurality of rack teeth each have a flat portion in the region of a trough centre line, wherein the trough in the region of the flat portion is planar.

15. The rack bar according to claim 14, wherein the flat portion is about the same width as associated flat portions on the plurality of drive sprocket teeth.

16. The rack bar according to claim 1, wherein the plurality of rack teeth each have a flat portion in the region of a trough centre line, wherein the flat portion has a width about $1/10$ to $1/7$ of a distance between the supporting strip and the guide strip.

* * * * *